US005546876A

United States Patent [19]

Schilling et al.

[11] Patent Number: 5,546,876

[45] Date of Patent: Aug. 20, 1996

[54] SEWING UNIT WITH A FABRIC HOLDER DISPLACEABLE RELATIVE TO A THREAD-GUIDING NEEDLE AND WITH A FABRIC PRESSER FOOT WITH AN ASYMETRICALLY WIDENED OPENING

[75] Inventors: Lothar Schilling, Kaiserslautern; Gottfried Schmidt, Stebach, both of Germany

[73] Assignee: G. M. Pfaff Aktiengesellschaft, Kaiserslautern, Germany

[21] Appl. No.: 441,031

[22] Filed: May 15, 1995

[30] Foreign Application Priority Data

Dec. 23, 1994 [DE] Germany ..... 44 46 138.0

[51] Int. Cl.[6] ..... D05B 21/00; D05C 9/06

[52] U.S. Cl. ..... 112/102.5; 112/235; 112/470.06

[58] Field of Search ..... 112/470.06, 470.07, 112/470.09, 470.11, 235, 102.5, 103

[56] References Cited

U.S. PATENT DOCUMENTS 5,261,340 11/1993 Conley, Jr. et al. ..... 112/470.06 X 5,377,605 1/1995 Frye ..... 112/470.06 X

*Primary Examiner*—Peter Nerbun

*Attorney, Agent, or Firm*—McGlew and Tuttle, P.C.

[57] ABSTRACT

A sewing unit with a thread-guiding needle, with a lock stitch hook with a thread reserve, with a fabric holder that can be moved in any direction relative to the needle axis, and with a fabric presser foot with a needle passage opening, which can be placed on the fabric in cycle with the movement of the needle. Loop or twist stitches are formed in an area of the possible directions of movement of the fabric holder. To pull these stitches reliably into the fabric, the needle passage opening is asymmetrically widened beginning from the site of the needle passage, namely, elliptically beginning from a part semi-circularly surrounding the site of the needle passage in one design, and angularly with an arched limiting edge connecting the legs of the angle in another design.

6 Claims, 2 Drawing Sheets

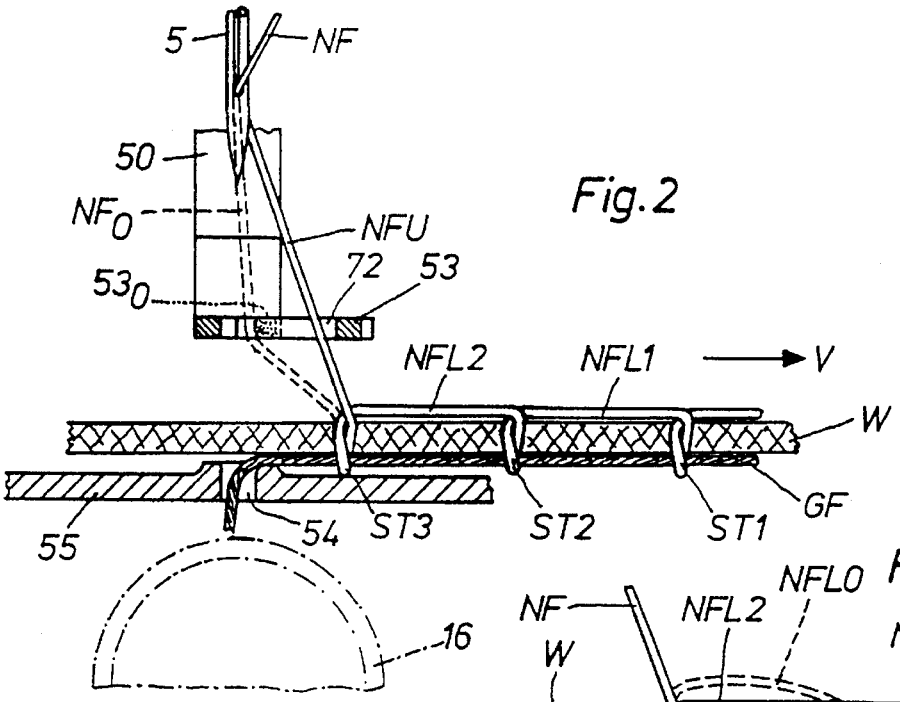
Fig.2
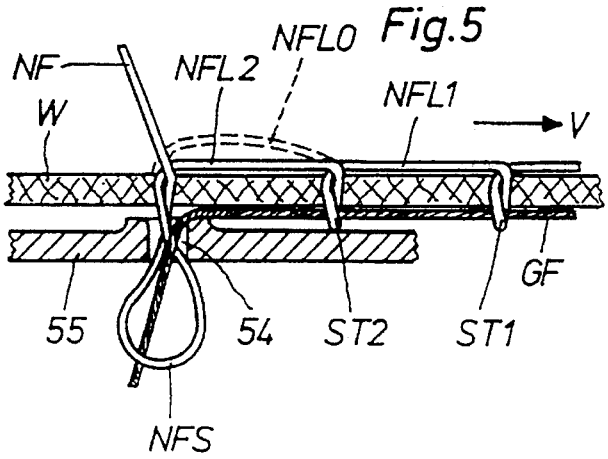
Fig.5
Fig.3
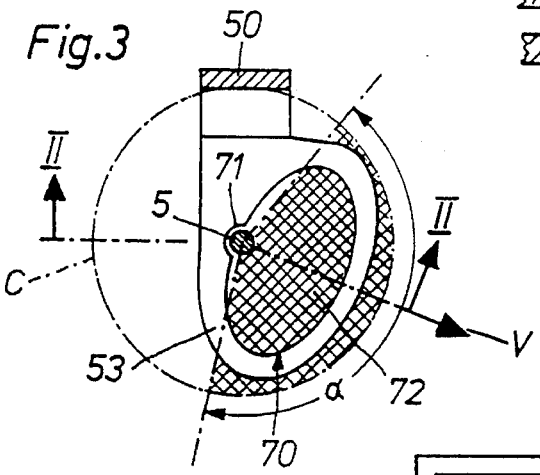
Fig.4
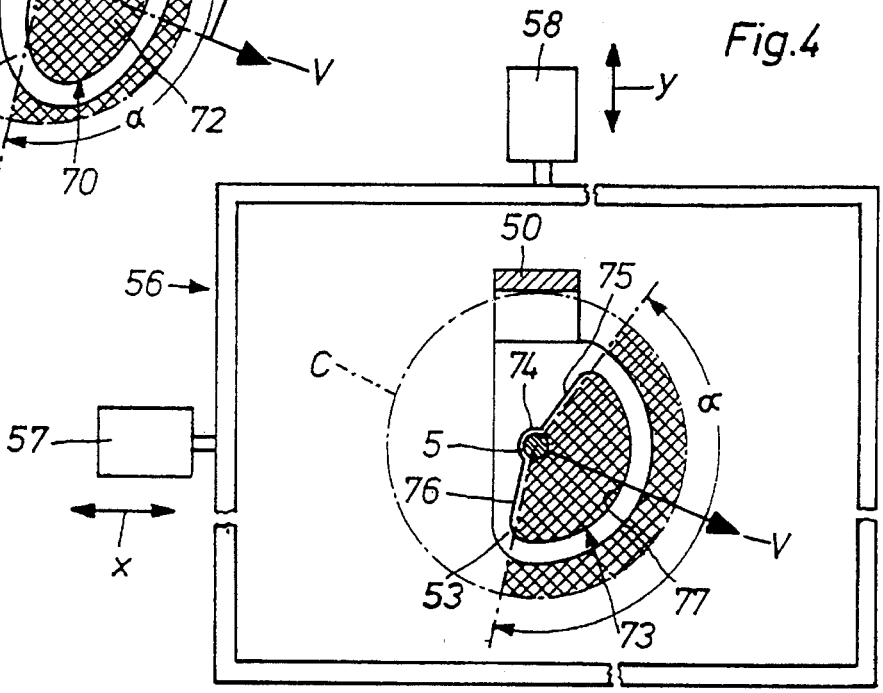

SEWING UNIT WITH A FABRIC HOLDER DISPLACEABLE RELATIVE TO A THREAD-GUIDING NEEDLE AND WITH A FABRIC PRESSER FOOT WITH AN ASYMETRICALLY WIDENED OPENING

FIELD OF THE INVENTION

The present invention pertains to a sewing unit with a thread guiding needle, which can be moved up and down and which cooperates with a lock stitch hook carrying a thread reserve; with a fabric holder, which can be moved in any desired direction in relation to the needle in an essentially horizontal plane; and with a fabric presser foot, which can be moved up and down cyclically with the movement of the needle and has a needle passage opening, wherein loop or twist stitches are formed in an area of the directions of movement of the fabric holder.

BACKGROUND OF THE INVENTION

Besides a normal, single looping of the hook thread by the needle thread, which is expanded by the hook into a loop, is led around the hook thread and is pulled by the thread lever to the fabric being sewn in a defined angle range of the fabric feed movement directions relative to the needle, single or double, so-called loop stitches or twist stitches are formed in all two-thread lock stitch sewing machines.

The looping and twisting ratios during the formation of normal two-thread lock stitches and of the two types of loop stitches and twist stitches are very clearly illustrated and described in German Offenlegungsschrift No. DE-OS 22 52 577.

In the normal two-thread lock stitch formed from a needle thread and a hook thread, in which the fabric being sewn is moved in a defined displacement direction predetermined by the fabric feed dog or in one direction, the section of the needle thread leaving the needle eye leads, together with the hook thread, to a preceding connection of the two threads (preceding stitch). After the insertion of the needle at the next stitch formation site, the loop formed during its upward movement from its reversal point between the needle and the hook thread is caught by the hook, led around the hook thread reserve and is pulled by the usual thread lever to the fabric being sewn such that the needle thread loops around the hook thread in a U-shaped pattern and around itself in an untwisted manner. Depending on the sewing operation to be performed, the immediate looping site of the two threads is pulled, e.g., up by the thread lever either only up to the underside of the fabric being sewn, as in the case of embroidering, pulled into the fabric being sewn, as in the case of the sewing together of two fabric layers, or it is pulled up to the top side of the fabric being sewn, as in the case of. e.g., the sewing of buttonholes.

The course of the needle thread and of the hook thread during the formation of a normal two-thread lock stitch is shown in FIGS. 4–7 and 12–15 of DE-OS 22 52 577.

However, if the fabric being sewn is moved by the fabric holder in any desired direction relative to the needle, such as, e.g., in embroidering machines with a fabric holder that is designed as a cross slide or stretching frame and is movable in two directions at right angles to one another or in sewing units for preparing decorative or ornamental seams, so-called loop or twist stitches, in which the needle thread led around the hook thread is singly or doubly looped as a loop or twisted, are formed during the displacement of the fabric being sewn in a radial direction away from the needle in an angle range that depends on the design of the hook.

In the case of a single loop or twist stitch, whose formation is shown in FIGS. 8–11 of DE-OS 22 52 577, the fabric being sewn is moved, prior to the insertion of the needle at the insertion site of the needle that is offset by one stitch length compared with the stitch last formed, in a direction in which the section of the needle thread leaving the needle eye comes to lie on the side of the needle facing away from the hook thread and on the side facing away from the circumferential direction of the hook. As a consequence of this, the needle thread loop being formed during the upward movement after the lower reversal point of the needle is twisted once when it is caught by the hook and is led by it around the hook thread reserve as a loop. As a result, a larger thread volume, which makes it difficult to pull in the stitch, is formed at the connection point of the needle thread and the hook thread. The pulling in of the stitch is made additionally difficult by the coefficients of friction generated in the fabric in the case of the oblique course of the needle thread section leaving the fabric.

In the two-thread loop or twist stitch, whose formation is shown in FIGS. 16–19 of the German Offenlegungsschrift DE-OS 2252577, the fabric being sewn is moved, prior to the insertion of the needle at the insertion site that is offset by one stitch length compared to the stitch last formed, in a direction in which the section of the needle thread leaving the needle eye and the section of the hook thread extending to the stitch last formed come to lie on the side of the needle located in the circumferential direction of the hook in front of the hook thread extending between the needle and the two needle thread sections. As a result, the loop of the needle thread led by the hook around the hook thread is twisted twice. The thread volume is consequently increased further at this connection point of the threads, and the pulling in of the stitch is made even more difficult, especially because the coefficients of friction also increase in the case of the oblique course of the needle thread during the pulling in of the stitch due to the increased thread volume.

DE-OS 22 52 577 not only points out the problem that the above-described loop or twist stitches are formed in sewing units with a fabric holder movable in two coordinate directions at right angles to one another in one plane, but it also stresses the drawbacks of these abnormal stitches. Aside from the aesthetically unattractive appearance of such stitches, which is due to the twisting of the needle thread, a pinching effect, which affects the tension conditions of the threads in a highly unfavorable manner, is produced, especially in the case of thicker threads.

Besides, it may happen that one of the threads gets into the path of movement of the needle between the formation of consecutive stitches, so that the needle punctures the thread, thus weakening or even severing it.

As a solution to avoid these drawbacks, DE-OS 22 52 577 provides for pivoting the fabric holder during the displacing movement into the angle range in which the loop or twist stitches are formed, as a whole around the longitudinal axis of the needle, in order to thereby bring the thread sections participating in the stitch formation into a mutual position necessary for normal lock stitch formation. Since the mass of the fabric holder to be pivoted and the drive and control means necessary for this are relatively large, this solution allows only a reduced work speed, with a reduction in the efficiency of the sewing unit, because the actual pivoting of the fabric holder between two stitches must be selected depending on the greatest pivoting angle, and it takes a certain amount of time, which could be substantially shorter in the case of small pivoting angles.

In U.S. Pat. No. 3,827,382, which is a patent of the applicant of DE-OS 22 52 577, the pivoting of the fabric holder with its drive and control means was omitted in a machine similar to the sewing unit according to the German Offenlegungsschrift DE-OS 22 52 577, and the formation of loop or twist stitches in such sewing units was thus accepted as a basic sewing technical feature. The pinching effect occurs due to the twisting of the thread and is greatly increased compared with a normal lock stitch, during the pulling in of the stitch by the thread layer. This leads to the unsatisfactory pulling in of the threads into the fabric being sewn in the loop or twist stitch area. To counteract this a solution was proposed, according to which the tensioning force acting on the needle thread is varied such that it is increased by pneumatically operating adjusting means, which are activated via an automatic control device, during the fabric feed into the loop or twist stitch area. The twisting of the thread takes place, in order to achieve improved pulling in of the stitch, and the tensioning force is reduced to the lower tensioning force during the feed of the fabric into the area for normal lock stitch formation.

However, the fact that the pinching force is considerably greater in the case of double twisting of the thread than in the case of a single twisting of the thread is not taken into account here. The consequence of this is that loop or twist stitches that are pulled in differently are formed.

However, the frictional resistance that occurs due to the increase in the pinching force is due not only to the twisting of the needle thread; it is also increased by the circular design of the needle passage opening in the fabric presser foot. The section of the needle thread leading to the last connection of the two threads is therefore inherently deflected around the limiting edge of the needle passage opening during the fabric feed, so that the section of the needle thread leading to the needle eye is bent off relatively abruptly toward the longitudinal axis of the needle.

When especially thick threads are processed, the coefficients of friction, which add up due to the twisting of the thread and the deflection, almost lead to self-locking, which can hardly be overcome even by an increased tensioning force acting on the needle thread, because the stitch connection following the preceding stitch connection is pulled in, and the fabric feed to the next insertion site takes place with the fabric presser foot lifted off and with the needle removed from the fabric. Therefore, the fabric does not form an adequate abutment for the increased frictional resistance occurring during loop or twist stitches during the thread intake phase. It is consequently increased during the pulling in of the stitch, and the section of the needle thread leading to the preceding stitch connection is partially pulled out of the fabric and is loosely raised over the fabric surface in the form of an arch. At any rate, the increased thread tension fails to solve the problem.

SUMMARY AND OBJECT OF THE INVENTION

The primary object of the present invention is to substantially reduce the frictional resistance during loop or twist stitches during the pulling in of the stitch and to facilitate the pulling in of loop or twist stitches.

According to the invention, a sewing unit is provided with a thread guiding needle. The needle can be moved up and down and cooperates with a lock stitch hook carrying a thread reserve. A fabric holder is provided which can be moved in any desired direction in relation to the needle in an essentially horizontal plane. A fabric presser foot is provided which can be moved up and down cyclically, with the movement of the needle. The fabric presser foot has a needle passage opening. Loop or twist stitches are formed in an area of the direction of movement of the fabric holder. The needle passage opening of the fabric presser foot is symmetrically widened beginning from a site of the needle passage, covering the looping and twisting area.

The deflection of the needle thread in the looping and twisting area of the fabric feed direction is avoided due to this measure at the most commonly used stitch lengths, so that the frictional resistance is reduced to the frictional resistance that occurs due to the thread twisting alone, and correct pulling in of the stitch is ensured in the case of loop or twist stitches as well.

The design of the needle passage opening wherein the passage opening surrounds the site of the needle passage in a semi-circular pattern and is elliptically widened beginning from the semi-circular pattern, covering the looping and twisting area (angle $\alpha$), and forming the limiting edges of the needle passage opening by a semi-circular part at the site of the needle passage and by the legs of the angle $\alpha$ enclosing the looping and twisting area, which legs originate from the part, as well as by a limiting edge connecting the legs in an arched manner, is especially well adapted to the angle range of the fabric feed movement in which loop or twist stitches are formed.

The height position of the fabric presser foot is preferably adapted to the fabric thickness. This measure is used to adapt the working movement of the fabric holder to the thickness of the fabric.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2 is a sectional view according to line II—II in FIG. 3 with the comparison of thread deflection in the case of a circular passage opening for the needle and thread deflection in the case of the design of the passage opening according to the present invention, FIG. 3 is a top view of one embodiment of the pressing part of the fabric presser foot with indication of the loop or twist stitch area within a full circle represented by dash-dotted line, in which the fabric holder shown schematically in FIG. 4 is movable in any desired feed direction, FIG. 4 is a representation of another embodiment of the pressing part of the fabric presser foot similar to the representation in FIG. 3, with a fabric holder represented in a schematically simplified manner, and FIG. 5 is a sectional view of the connection of the threads during the formation of loop or twist stitches.

DETAILED DESCRIPTION OF THE PREFERRED EMBODIMENTS

Figure 1:
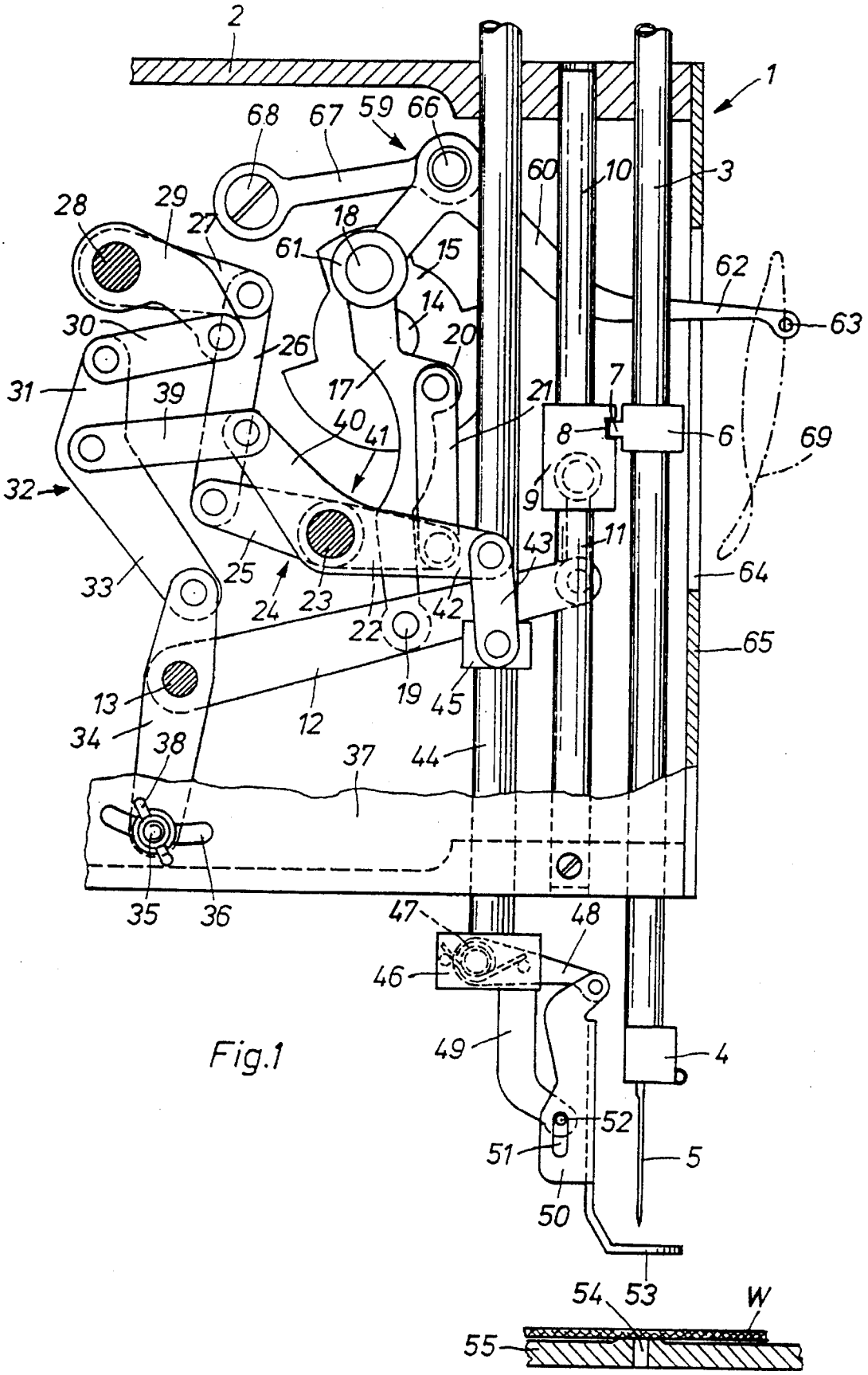
FIG. 1 is a partially cutaway side view of the sewing head part of an embroidering machine.

FIG. 1 shows a partially cutaway representation of the sewing head part 1 of an embroidering machine. The usual needle bar 3, which carries at its lower end a needle holder 4, to which the needle 5 is attached, is mounted in the machine housing 2 in such a manner that it can be moved up and down.

A carrier 6, which engages a slot 8 of a sliding block 9 with a coupling projection 7, is attached to the needle bar 3. The sliding block 9 is mounted axially movably on a guide rod 10 fastened in the machine housing in parallel to and at a spaced location from the needle bar 3. The sliding block 9 is connected by a connecting rod 11 to the free end of a rocking lever 12. This rocking lever 12 is mounted with its other end on the machine housing 2 by means of a pivot pin 13. The rocking lever 12, which is in drive connection with the sliding block 9, is driven by a crank 15 fastened to the main drive shaft 14. The crank 15 is in drive connection with all the machine parts arranged in the sewing head part 1. Via a gear train, not shown, the main drive shaft 14 is in drive connection with the lock stitch hook 16 (FIG. 2) which is indicated by dash-dotted line in FIG. 2 and carries a reserve of hook thread GF.

One end of a drive rod 17 is mounted in the crank 14 by means of a pin 18 fastened in the crank 15 in parallel to and at a spaced location from the main drive shaft 14. The other end of the drive rod 17 is connected by a hinge pin 19 to the rocking lever 12 approximately in the middle, and it is thus in connection with the carrier 6 attached to the needle bar 3 for driving the needle bar 3 via the connecting rod 12, the sliding block 9 and the coupling projection 7 engaging its slot 8.

A lateral mounting projection 20 of the drive rod 17 is connected by a connecting rod 21 to one arm 22 of a two-armed rocking lever 24, which is mounted pivotably around a pivot pin 23 that is a fixed part of the housing, and the other arm 25 of the rocking lever 24 is connected by a tie rod 26 to the free end of a one-armed lever 27, which is fastened to a rocking shaft 28 mounted in the machine housing 2 at a lateral distance from and in parallel to the main drive shaft 14.

Another one-armed lever 29 is also fastened to the rocking shaft 28. The free end of this one-armed lever 29 is in connection via a connecting rod 30 with one arm 31 of a two-armed rocking lever 32, whose second arm 33 is connected to one end of an adjusting lever 34 arranged pivotably on the pivot pin 13. A mushroom head bolt 35, which extends to the outside through an arched slot 36 of the housing cover 37, is inserted into the other end of the adjusting lever 34. A wing nut 38 on the mushroom head bolt 35 is used to fix the adjusting lever 34.

The rocking lever 32 is connected by a coupler 39 to one arm 40 of a two-armed rocking lever 41, which is mounted pivotably around a pivot pin 23, and whose other arm 42 engages, via a compensating connecting rod 43, a carrier 45 fastened to a pressure bar 44 that can be moved up and down in the housing 2.

A bracket 46, to which a rocker 48 supported via a torsion spring 47 is hinged and with which a support 49 is made in one piece, is fastened to the lower end of the pressure bar 44.

At its free end, the rocker 48 accommodates a fabric presser foot 50 in an articulated manner. The presser foot has a vertically extending elongated hole 51, which is engaged by a pin 52, which is fixed in the lower end of the support 49, for guiding the fabric presser foot 50.

The pressing part 53 of the fabric presser foot 50 is bent at an angle and can be placed on the fabric W lying on the needle plate 55 having a stitch hole 55 in the cycle of the movement of the needle bar. The pressing part 53 is shown on a larger scale in FIGS. 2, 3 and 4, and, as was mentioned in the introduction. FIGS. 3 and 4 show embodiments of various designs of the passage opening for the thread-guiding needle 5, which will be described in greater detail below with respect to the conditions of an embroidering machine. To accommodate a plurality of fabric holders (not shown) for clamping in the fabric W, the embroidering machine has an embroidery hoop 56 (FIG. 4) which can be moved in two coordinate directions X and Y that are at right angles to one another, and which can be moved by program-controlled stepping motors 57, 58 in the coordinate directions X, Y.

To control the needle thread NF and the pulling in of the thread during stitch formation, the usual thread lever 59, FIG. 1, is provided, whose angularly shaped thread lever 60 is mounted with one leg 61 on the pin 18 fastened in the crank 15, and which partially extends to the outside through a slot 64 in the head plate 65 with the other leg 62, whose free end has a thread eye 63. In the vertex area of the two legs 61, 62, the thread lever 60 is connected by a pin 66 to a rocker 67, which is mounted on a shank screw 68 screwed into the housing 2. The thread eye 63 of the thread lever 60 moves on a path 69 indicated by a dash-dotted line in FIG. 1 during the revolution of the main drive shaft 14.

As is described in the description of the figures, FIGS. 3 and 4 show two exemplary embodiments of the horizontal pressing part 53 of the fabric presser foot 50 on a larger scale. The range of movement of the embroidery hoop 56, which can be moved by the stepping motors 57, 58 in the coordinate directions Y, Y (FIG. 4) relative to the longitudinal axis of the needle, in which range stitches are formed with the stitch lengths used most frequently, is indicated by the full circle "C" shown in dash-dotted line in both figures.

Normal two-thread lock stitches are formed during the radial displacement of the embroidery hoop 56 carrying the fabric holders into the unshaded area of the full circle C from one insertion site of the needle 5 to the next.

In contrast, the so-called loop or twist stitches St1, St2, St3, in which the needle thread NF led by the lock stitch hook 16 around the hook thread GF is additionally twisted, as is shown in FIGS. 2 and 5, are formed during the radial displacement of the embroidery hoop 56 from one insertion site of the needle to the next into the crosshatched, shaded area of the full circle C, which is defined by the angle $\alpha$.

Increased frictional resistance is generated by the twisting when the stitch is being pulled by the thread lever 60 into the fabric W. This frictional resistance is further increased in the prior-art sewing and embroidering machines, whose fabric presser feet have a circular needle passage opening, by the fact that the section $NF_0$ of the needle thread leaving the fabric is deflected around the circular limiting edge of the needle passage opening of the presser foot lifted off from the fabric during the pulling in of the stitch, and thus it is bent off abruptly, especially if the stroke of the fabric holder 50 is small, which is always desirable, and this abrupt bending leads to a considerable additional frictional resistance. To prevent this additional frictional resistance from forming, the needle passage opening 70 in the exemplary embodiment of the pressing part 53 shown in FIG. 3 is widened beginning from the site of the needle passage, surrounding the needle passage on the side facing away from the angle range "$\alpha$," in a semicircular pattern 71, asymmetrically, with respect to the needle passage site essentially covering the loop stitch and twist stitch area (angle $\alpha$), and elliptically 72 in this example.

In the exemplary embodiment of the pressing part 53 according to FIG. 4, the needle passage opening 73 surrounds the site of the needle passage in a semicircular pattern 74 on the side facing away from the angle range α. Limiting edges 75, 76, which enclose the loop stitch or twist stitch area in the angle α, are parallel to the legs of the angle α, and are connected by an arc-shaped limiting edge 77, originate from the semicircular limiting edge 74.

The advantages achieved by the design of the needle passage opening 70 or 73 according to the present application will be explained on the basis of FIGS. 2 through 5.

The course of the section of the needle thread leaving the fabric, which is designated by $NF_0$ and is shown in broken line, in the case of the prior-art design of the pressing part of the fabric presser foot with a prior-art circular needle passage opening, which pressing part is shown in dotted line and is designated by $53_0$, is compared in FIG. 2 with the course of the section NFU of the needle thread NF leaving the fabric W in the design of the needle passage opening 70 according to the present invention. This thread course also corresponds to that seen in the case of the design of the needle passage opening 73 according to FIG. 4.

The comparison shows that the thread section $NF_0$ is bent abruptly in a circular needle passage opening, but the section NFU of the needle thread NF leaving the fabric W is not because of the widened needle passage opening 70 or 73, respectively. This means that the thread section $NF_0$ is in frictional contact with the fabric presser foot during the fabric feed to the site of the next insertion of the needle and during the pulling in of the stitch and leaves the fabric in a very oblique direction relative to the fabric surface. The stitch is therefore pulled in under substantially more unfavorable conditions than in the object of the present application. This will be discussed in greater detail later.

Mode of Operation:

It is assumed that one sewing fabric or embroidery fabric holder, not shown, is assigned to each of the embroidery heads 1 of a multihead embroidering machine (only one is shown as an example in FIG. 1). A workpiece W is clamped in each fabric holder, and the fabric holders are fastened to the embroidery hoop 56, FIG. 4. With the machine running, a few loop or twist stitches St1, St2, St3, FIG. 2 have already been formed during the displacement of the embroidery hoop 56 into the looping and twisting area (angle "α") corresponding to the feed direction indicated by arrow V, and, with the needle 5 lifted out of the fabric and with the presser foot 50 lifted off from the workpiece W, the embroidery hoop 56 has already been fed partially to the site of the next insertion of the needle 5 in the direction of arrow V by the stepping motors 57, 58 to form another loop or twist stitch, and the machine is stopped there. This situation is shown in FIG. 2, in which the sewing head parts assume their position shown in FIG. 1.

The processes taking place during the formation of, e.g., the loop or twist stitch St3 will be explained in greater detail below on the basis of FIG. 5. FIG. 5 shows in greater detail a situation in which the needle thread NF has been led around the hook thread GF in form of the loops NFS, which has been thrown off from the hook 16 and in which situation the stitch St3 consisting of the needle thread NF and the hook thread GF is just about to be pulled into the workpiece W by the thread lever 59 during the remainder of the upward stroke of the thread take-up lever 60/62.

However, the mode of operation of the sewing head parts will first be described. After the machine drive has been switched on, the crank 15 fastened to the main drive shaft 14 drives the rocking lever 12 via the drive rod 17, the rocking lever 24 via the connecting rod 21, the thread lever 59 via the leg 61 of the thread lever 60, and the lock stitch hook 16, FIG. 2, in a manner not shown, and the thread eye 63 of the thread lever 60 is moved along the path 69.

The sliding block 9 is moved up and down on the guide rod 10 by the connecting rod 11 connected to the rocking lever 12 and to the sliding block 9. The needle bar 3 with the thread-guiding needle 5 fastened in its needle holder 4 is now moved up and down via the coupling projection 7 of the carrier 6 fastened to the needle bar 3, which coupling projection 7 engages the slot 8 of the sliding block 9.

The rocking lever 24 driven via the connecting rod 21 imparts oscillating movements to the rocking shaft 28 via the tie rod 26, which is connected with its arm 25 to the lever 27 fastened to the rocking shaft 28. These movements are transmitted to the rocking lever 32 via the lever 29 fastened to the rocking shaft 28 and the connecting rod 30. The rocking lever 32 transmits the drive movement via the coupler 39 to the rocking lever 41, which imparts up and down movements to the pressure bar 44 in the cycle of the movement of the needle bar via the connecting rod 43, which acts on the carrier 45 fastened to the pressure bar 44, and the fabric presser foot 50 with its pressing part 53 remaining seated on the workpiece W until the needle 5 guiding the needle thread NF brings the needle thread NF to the lower reversal point through the needle passage opening 70 or 73, the workpiece W and the stitch hole 54 of the needle plate 55, after which the formation of a thread loop NFS, FIG. 5, is terminated at the beginning of the upward movement of the needle, and the needle thread loop NFS is caught by the hook 16.

The phase of needle movement from its lower reversal point until the time at which the needle thread loop NFS is caught by the hook 16 is called the loop stroke in the technical language.

To ensure the correct formation of the needle thread loop NFS to be caught by the hook 16 during the loop stroke, not only will the pressing part 53 of the fabric holder 50 remain seated on the workpiece W until the needle thread loop NFS is caught by the hook 16, but the same purpose is also served by the design 71 or 74 of the needle passage opening 70 or 73, which surrounds the site of insertion of the needle 5 in a semicircular pattern. These measures prevent the workpiece W from being raised during the phase of the loop stroke at the time of the pulling in of the stitch by the thread lever 60, which takes place at high speed during the upward movement of the needle, because the section of the needle thread NF leaving the workpiece W is in frictional contact with the workpiece W.

Once the needle thread loop NFS has been caught by the hook 16, the needle thread loop NFS has been led around the hook thread GF, and the stitch has been pulled in, the needle 5 leaves the workpiece W, and the fabric presser foot 50 with its pressing part 53 is lifted off from the workpiece W in order for the embroidery hoop 56 to be able to feed the workpiece W to the site of the next insertion of the needle. As was mentioned, the section NFU of the needle thread NF leaving the workpiece W is in frictional contact with the workpiece W during the pulling in of the stitch. The thread section NFL2, which was still lying flat on the workpiece surface during the insertion of the needle into the workpiece W, is partially lifted out of the workpiece as a result during the pulling in of the stitch, and built up into the loop $NFL_0$, which is shown in broken line in FIG. 5. This undesired process is an inherent feature of the system and is unavoidable. The basic task is to cause this loop $NFL_0$ to again lie flat on the top side of the fabric, especially because the stitch St2 formed last is also loosened to some extent due to the loop formation.

The needle 5 has already left the workpiece W by the time of the pulling in of the stitch, and the workpiece W located in the embroidery hoop 56 is being fed to the next needle insertion position. As a result, the last site of insertion of the needle 5 is offset at stitch St2 relative to the longitudinal axis of the needle. Therefore, the section $NF_0$ led to the eye of the needle 52 by the thread lever 60 or NFU no longer leaves the workpiece W vertically, but obliquely to the top side of the workpiece. If the thread lever 60 has again fed all the excess needle thread NF from the underside of the workpiece to the top side of the workpiece, i.e., shortly before reaching the top reversal point of the thread eye 63 along its path of movement 69, the needle thread NF becomes tight, and a pulling force is generated in it. What is decisive now is that the excess needle thread in the needle thread loop NFS, FIG. 5, deflected by the hook thread GF in the last needle insertion site at St3 (FIG. 2), be pulled into the workpiece W, that it reach again the surface of the workpiece under the effect of the thread pulling force, so that the loop $NFL_0$ on the surface of the workpiece will be pulled out flat, and the loosening in stitch St2 will also be eliminated.

The section NFU of the needle thread NF leaving the workpiece W lies on the descending section of the needle thread NF in this process because of the twisting, as can be recognized especially clearly from FIG. 5, and it presses it against the material of which the workpiece W consists.

Complex friction conditions develop, which increase the pulling force in the needle thread NF during the pulling in of the stitch, and may even lead to self-locking, depending on the properties of the material of the workpiece W and on properties that depend on the thickness of the needle thread NF.

Since the workpiece W is not held by the presser foot 50 on the needle plate 55 during the feed movement to the site of the next needle insertion, the workpiece W is lifted off from the needle plate 55 when a defined limit value of the pulling force is exceeded, so that the pulling force decreases in the needle holder needle thread NF, and the pulling in of the stitch will fail. The pulling in of the loop cannot be forced to take place even by a clamping force exerted by the usual thread-tensioning device on the needle thread NF, however strong it may be, because the fabric has been lifted off from the needle plate 55.

Additional frictional forces are generated if the needle thread $NF_0$ is pulled off, as when a presser foot with a circular needle passage opening is used, in a highly oblique position abruptly bent around $53_0$, which causes deflection of the thread. In contrast, if the needle thread NF is pulled up by the thread lever 60 during the pulling in of the stitch along a course that extensively approximates the longitudinal axis of the needle, without a bend at the limiting edge of the needle passage opening 70 or 73, as is shown by solid lines at NFU in FIG. 2, both the above-mentioned complex friction conditions improve due to the increase in the reliability of the pulling in of the loop or twist stitch, and no additional frictional forces caused by thread deflection at the limiting edges of the design of the needle passage opening 70 or 73 according to the present invention are generated, because thread deflection, which would affect the course of the exiting section NFU of the needle thread NF during the pulling in of the stitch, does not take place at all when the most frequently needed stitch lengths between two consecutive stitches are used.

It should also be mentioned that the height position of the fabric holder 50 can be optimally adjusted to the thickness of the fabric in a simple manner. To do so, only the wing nut 38 is to be loosened and the adjusting lever 34 is to be pivoted in one direction or another around the pivot pin 13 as needed, and the angular position of the rocking shaft 28 is changed via the connecting rod 30 and the lever 29, and thus the height position of the pressure foot 44 with the fabric holder 50 is changed via the parts 39, 41, 43 and 45. This setting can be fixed by tightening the wing nut 38.

While specific embodiments of the invention have been shown and described in detail to illustrate the application of the principles of the invention, it will be understood that the invention may be embodied otherwise without departing from such principles.

What is claimed is:

1. A sewing unit, comprising:

a thread guiding needle, said needle being movable up and down;

a lock stitch hook carrying a thread reserve, said lock stitch hook cooperating with said needle;

a fabric holder;

means for moving said fabric holder in any desired direction in relation to the needle, in an essentially horizontal plane;

a fabric presser foot which can be moved up and down in cycle with the movement of the needle, said presser foot having a needle passage opening, wherein loop or twist stitches are formed in an area of the direction of movement of the fabric holder, said needle passage opening covering the looping and twisting area over an angular range $\alpha$ where $\delta$ is an obtuse angle defined by two lines which originate at the needle.

2. A sewing unit according to claim 1, wherein said needle passage opening surrounds a site of the needle passage in a semi-circular pattern, said widened opening being elliptically widened beginning from said site of said needle passage and covering said looping and twisting area over said angular range $\alpha$.

3. A sewing unit according to claim 1, wherein limiting edges of the needle passage opening are formed by a semi-circular part at said site of the needle passage and by legs of said angle $\alpha$, enclosing the looping and twisting area, said legs originating from the semi-circular part, a limiting edge being connected to said legs in an arched manner.

4. A sewing unit according to claim 1, further including height adjustment means for adjusting a height position of the fabric presser foot based on the fabric thickness.

5. A sewing unit according to claim 1, wherein:

said needle passage opening asymmetrically widens from a needle passage site.

6. A sewing unit according to claim 1, wherein:

said needle passage opening has a needle passage site where said needle passes through said needle passage opening, said needle passage opening extending asymmetrically from said needle passage site.

* * * * *